US011069969B2

(12) United States Patent
Fan

(10) Patent No.: US 11,069,969 B2
(45) Date of Patent: Jul. 20, 2021

(54) ANTENNA ASSEMBLY AND ELECTRONIC DEVICE

(71) Applicant: BEIJING XIAOMI MOBILE SOFTWARE CO., LTD., Beijing (CN)

(72) Inventor: Jie Fan, Beijing (CN)

(73) Assignee: Beijing Xiaomi Mobile Software Co., Ltd., Beijing (CN)

( * ) Notice: Subject to any disclaimer, the term of this patent is extended or adjusted under 35 U.S.C. 154(b) by 28 days.

(21) Appl. No.: 16/699,487

(22) Filed: Nov. 29, 2019

(65) Prior Publication Data

US 2020/0274238 A1 Aug. 27, 2020

(30) Foreign Application Priority Data

Feb. 22, 2019 (CN) ..... 201910133150.2

(51) Int. Cl.
*H01Q 1/52* (2006.01)
*H01Q 1/12* (2006.01)

(52) U.S. Cl.
CPC ..... *H01Q 1/52* (2013.01); *H01Q 1/12* (2013.01)

(58) Field of Classification Search
CPC ..... H01Q 1/12; H01Q 1/52; H01Q 1/243
See application file for complete search history.

(56) References Cited

U.S. PATENT DOCUMENTS 7,307,592 B2 * 12/2007 Park ..... H01Q 1/243 343/702
2016/0283027 A1 9/2016 Hao et al.
2019/0173176 A1 * 6/2019 Kim ..... H01Q 5/371

FOREIGN PATENT DOCUMENTS

CN 103091922 A 5/2013
CN 104765490 A 7/2015
CN 107425876 A 12/2017
CN 209298326 U 8/2019
EP 1760827 A1 8/2017
KR 0147910 B1 10/1998
(Continued)

OTHER PUBLICATIONS

First Office Action issued in Korean Patent Application No. 10-2019-7029871 dated Aug. 21, 2020 with English translation, (8p).
(Continued)

*Primary Examiner* — Hasan Islam
(74) *Attorney, Agent, or Firm* — Arch & Lake LLP

(57) ABSTRACT

An antenna assembly includes: an antenna receiving terminal including a first conductive region; a charge releasing terminal including a second conductive region; a clearance area disposed between the antenna receiving terminal and the charge releasing terminal; a charge discharging member disposed at the first conductive region, where the charge discharging member extends toward the charge releasing terminal, and forms a first apex angle close to the charge releasing terminal; and a charge recovering member corresponding to the charge discharging member disposed at the second conductive region, where the charge recovering member extends toward the antenna receiving terminal, and forms a second apex angle close to the antenna receiving terminal, where a distance between the first and second apex angles is less than or equal to a preset distance, so as to initiate an arc discharge between the first and second apex angles.

20 Claims, 3 Drawing Sheets

(56) References Cited

FOREIGN PATENT DOCUMENTS

| | | | |
|---|---|---|---|
| KR | 20050041470 | A | 5/2005 |
| KR | 20090097029 | A | 9/2009 |
| KR | 101751825 | B1 | 7/2017 |
| TW | 352173 | U | 1/2009 |

OTHER PUBLICATIONS

Extended European Search Report of European Application No. 19211193.8 dated May 13, 2020, (9p).
International Search Report to PCT Application No. PCT/CN2019/099405 dated Nov. 26, 2019 with English translation, (20p).

* cited by examiner

ANTENNA ASSEMBLY AND ELECTRONIC DEVICE

CROSS-REFERENCE TO RELATED APPLICATIONS

This application is based on and claims priority to Chinese Patent Application No. 201910133150.2, filed on Feb. 22, 2019, the entire contents of which are incorporated herein by reference for all purposes.

TECHNICAL FIELD

The present disclosure relates to a field of electronics, and more particularly to an antenna assembly and an electronic device.

BACKGROUND

In the related art, an antenna is required in an electronic device such as a mobile phone, so as to realize a communication function, and the antenna should not only be away from metal components in the electronic device, but also be isolated from components such as a battery, an oscillator, a shield cover and a camera, to define a clearance area, thus ensuring an omni-directional communication function of the antenna.

With development of a full display screen in the electronic device such as a mobile phone, the clearance area is decreased due to limited space, resulting in negative effects on transmission and reception performances of the antenna. Moreover, an increase in the clearance area of the full-screen electronic device may cause difficulties in releasing static electricity in the clearance area.

Therefore, there is still an urgent need for providing an antenna with increased clearance area and improved electrostatic safety in the art.

SUMMARY

The present disclosure provides an antenna assembly and an electronic device.

In a first aspect of the present disclosure, an antenna assembly is provided, including: an antenna receiving terminal including a first conductive region; a charge releasing terminal including a second conductive region; a clearance area disposed between the antenna receiving terminal and the charge releasing terminal; a charge discharging member disposed at the first conductive region of the antenna receiving terminal, where the charge discharging member extends toward the charge releasing terminal, and forms a first apex angle close to the charge releasing terminal; and a charge recovering member corresponding to the charge discharging member disposed at the second conductive region of the charge releasing terminal, where the charge recovering member extends toward the antenna receiving terminal, and forms a second apex angle close to the antenna receiving terminal, where a distance between the first apex angle and the second apex angle is less than or equal to a preset distance, so as to initiate an arc discharge between the first apex angle and the second apex angle.

In an example, two charge discharging members may be disposed at two opposite ends of the first conductive region of the antenna receiving terminal.

In an example, a plurality of charge discharging members may be uniformly distributed at the first conductive region of the antenna receiving terminal.

In an example, the preset distance may be less than or equal to 1.2 mm.

In an example, the charge discharging member and the charge recovering member may be made of a material including a metal.

In an example, the charge discharging member and the charge recovering member may have a saw-tooth shaped cross-section.

In an example, the first apex angle of the charge discharging member and the second apex angle of the charge recovering member may be made of a material including gold.

In an example, the antenna assembly may further include an insulating separator, located between the antenna receiving terminal and the charge releasing terminal and assembled at the antenna receiving terminal or the charge releasing terminal.

In an example, the insulating separator may be assembled at a periphery region of the antenna receiving terminal or the charge releasing terminal.

In a second aspect of the present disclosure, an electronic device is provided, including a body and an antenna assembly assembled in the body, the antenna assembly including: an antenna receiving terminal including a first conductive region; a charge releasing terminal including a second conductive region; a clearance area disposed between the antenna receiving terminal and the charge releasing terminal; a charge discharging member disposed at the first conductive region of the antenna receiving terminal, where the charge discharging member extends toward the charge releasing terminal, and forms a first apex angle close to the charge releasing terminal; and a charge recovering member corresponding to the charge discharging member disposed at the second conductive region of the charge releasing terminal, where the charge recovering member extends toward the antenna receiving terminal, and forms a second apex angle close to the antenna receiving terminal, where a distance between the first apex angle and the second apex angle is less than or equal to a preset distance, so as to initiate an arc discharge between the first apex angle and the second apex angle.

In an example, the body may include a first body and a second body that are stacked and slidably connected, in which the antenna receiving terminal may be disposed at the first body, the charge releasing terminal may be disposed at the second body, and the charge releasing terminal may correspond to the antenna receiving terminal such that the distance between the first apex angle and the second apex angle is always less than or equal to the preset distance.

In an example, the first body may include a screen component covering a front surface of the first body, the second body may include a middle frame, the antenna receiving terminal may be assembled in an edge region of a back surface of the first body, and the charge releasing terminal may be assembled in a position of the middle frame corresponding to the edge region of the back surface of the first body.

It is to be understood that both the foregoing general description and the following detailed description are exemplary and explanatory only and are not restrictive of the present disclosure.

BRIEF DESCRIPTION OF THE DRAWINGS

The accompanying drawings, which are incorporated in and constitute a part of this specification, illustrate examples consistent with the present disclosure and, together with the description, serve to explain the principles of the present disclosure.

DETAILED DESCRIPTION

Figure 1:
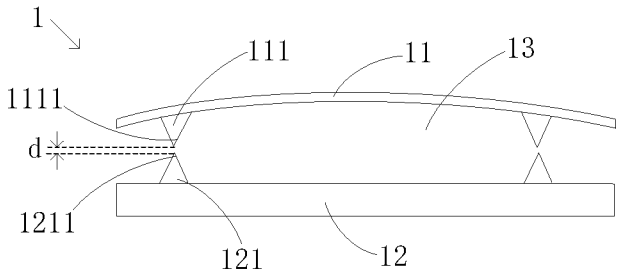
FIG. 1 is a sectional schematic diagram of an antenna assembly according to an exemplary aspect of the present disclosure.

Reference is made in detail to exemplary aspects, examples of which are illustrated in the accompanying drawings. The following description refers to the accompanying drawings in which the same numbers in different drawings represent the same or similar elements unless otherwise represented. The implementations set forth in the following description of exemplary aspects do not represent all implementations consistent with the present disclosure. Instead, they are merely examples of apparatuses and methods consistent with aspects related to the present disclosure.

The terminology used in the present disclosure is for the purpose of describing particular examples only and is not intended to limit the present disclosure. As used in this disclosure and the appended claims, the singular forms "a", "an", and "the" are intended to include the plural forms as well, unless the context clearly indicates otherwise. It should also be understood that the term "and/or" as used herein refers to and includes any and all possible combinations of one or more of the associated listed items.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

An antenna assembly is required in an electronic device such as a mobile phone, so as to realize a communication function, and the antenna assembly should not only be away from metal components in the electronic device, but also be isolated from components such as a battery, an oscillator, a shield cover and a camera, so as to define a clear area to ensure an omni-directional communication function of the antenna assembly. The clear area is also referred as the clearance area.

A screen component of a full-screen electronic device may cause a large interference to assembly space of the antenna assembly. Two solutions of reducing and increasing the clearance area are provided with respect to the above-mentioned interference of the assembly space. Specifically, if the clearance area is reduced, the transmission and reception performance of the antenna may be negatively affected due to signal interference generated from metal or other components inside the electronic device. When the electronic device is working, contact electrification may occur due to internal or external charges, and in this case, a simple increase of the clearance area of the full-screen electronic device will cause difficulties in releasing the static electricity in the clearance area, which also affects the transmission and reception performance of the antenna, and even causes a user's hand to sense the above electrostatic charge, thus reducing the user experience.

For example, the full-screen mobile phone may be a slider-type mobile phone, the screen of which covers 100% of a surface of the mobile phone. Such a mobile phone includes two parts, i.e., an upper slider body and a lower slider body, and the screen covers the upper slider body and function components such as a camera are arranged at the lower slider body. When a user needs to apply the corresponding functions, the lower slider body may slide out. With the above structure, the antenna assembly arranged at the upper slider body cannot ensure the static discharge of the clearance area of the antenna assembly at the moment when the lower slider body slides with respect to the upper slider body. The accumulation of static electricity may seriously affect the signal quality of the antenna or causes a feel sensed by a user's hand due to the static electricity.

FIG. 1 is a sectional schematic diagram of an antenna assembly according to an exemplary aspect of the present disclosure. With reference to FIG. 1, an antenna assembly 1 includes an antenna receiving terminal 11 including a conductive region (i.e. a first conductive region) and a charge releasing terminal 12 including a conductive region (i.e. a second conductive region). A clearance area 13 is formed or disposed between the antenna receiving terminal 11 and the charge releasing terminal 12. Specifically, a charge discharging member 111 is disposed at the conductive region of the antenna receiving terminal 11, extends toward the charge releasing terminal 12, and forms a first apex angle (or a first apex) 1111 close to the charge releasing terminal 12. A charge recovering member 121 corresponding to the charge discharging member 111 is disposed at the conductive region of the charge releasing terminal 12, extends toward the antenna receiving terminal 11, and forms a second apex angle (or a second apex) 1211 close to the antenna receiving terminal 11. A distance between the first apex angle 1111 and the second apex angle 1211 is less than or equal to a preset distance d, so as to initiate an arc discharge between the first apex angle 1111 and the second apex angle 1211, i.e., allowing discharge of static electricity.

By setting the distance between the first apex angle 1111 of the charge discharging member 111 and the second apex angle 1211 of the charge recovering member 121 to be less than or equal to the preset distance d, the electrostatic charges accumulated in the antenna receiving terminal and the clearance area can be released by arc discharge between the first apex angle 1111 and the second apex angle 1211. The above structure is simple to set up, reduces interferences to the structure and function of the whole antenna assembly 1, and also improves the electrostatic safety of the antenna assembly 1.

In the antenna assembly 1 according to the above examples, specific structures of the charge discharging member 111 and the charge recovering member 121 in the antenna assembly 1, and specific relationships between the charge discharging member 111 and the antenna receiving terminal 11 and between the charge recovering member 121 and the charge releasing terminal 12 may be various, which are exemplified by the following examples.

In an example, as shown in FIG. 1, two charge discharging members 111 are disposed at two opposite ends of the conductive region of the antenna receiving terminal 11. Since the electrostatic charges are generally accumulated in the clearance area 13 and travel around, the charge discharging members 111 located at the opposite ends of the conductive region of the antenna receiving terminal 11 can guide the electrostatic charges traveled to either end of the conductive region of the antenna receiving terminal 11 out, and interferences to structures of other regions of the antenna receiving terminal 11 caused by the charge discharging member 111 can also be reduced, thus improving the space utilization. In the example, two charge recovering members 121 are disposed at positions corresponding to the two charge discharging members 111.

Figure 2:
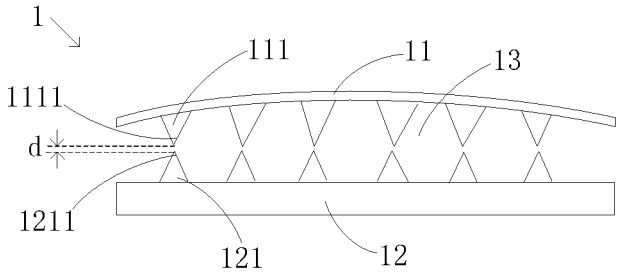
FIG. 2 is a sectional schematic diagram of an antenna assembly according to another exemplary aspect of the present disclosure.

In another example, as shown in FIG. 2, a plurality of charge discharging members 111 is uniformly distributed at the conductive region of the antenna receiving terminal 11. Since the electrostatic charges are generally accumulated in the clearance area 13 and travel around, the charge discharging members 111 uniformly distributed at the conductive region of the antenna receiving terminal 11 can guide the electrostatic charges traveled to the positions of the charge discharging members 111 out quickly, so as to improve the discharging efficiency, thus improving the electrostatic safety of the antenna assembly 1 and the electronic device 2. In the example, a plurality of charge recovering members 121 is disposed at positions corresponding to the plurality of charge discharging members 111. The charge recovering members 121 and the charge discharging members 111 are in one-to-one correspondence.

The more the electrostatic charges are gathered, the higher the energy is, and the less the electrostatic charges are gathered, the lower the energy is. If the distance between the first apex angle 1111 and the second apex angle 1211 is relative long, more accumulated charges are needed to generate the arc discharge. In other words, before the arc discharge, the accumulated electrostatic charges as described above will travel around in the clearance area 13, resulting in a potential risk in safety, and bad influence on radio frequency reception and signal transmission, thus affecting communication. If the distance between the first apex angle 1111 and the second apex angle 1211 is relative short, a small amount of accumulated charges is enough for the arc discharge and thus can be released. If the distance between the first apex angle 1111 and the second apex angle 1211 is smaller, the charges can be released more timely. In an example, the preset distance d between the first apex angle 1111 and the second apex angle 1211 is less than or equal to 1.2 mm, so as to improve the efficiency of releasing charges between the first apex angle 1111 and the second apex angle 1211, thus preventing excessive electrostatic charges from accumulating. Alternatively, the preset distance d may also be less than or equal to 1 mm to further improve the static discharge efficiency according to actual conditions.

In addition, during the releasing of the electrostatic charges, heat may be generated at the first apex angle 1111 and the second apex angle 1211. The heat is likely to cause deformation and passivation of the first apex angle 1111 and the second apex angle 1211, thus affecting the discharge path. On this basis, the material of the first apex angle 1111 of the charge discharging member and the second apex angle 1211 of the charge recovering member may be gold, to increase the service life of the first apex angle 1111 and the second apex angle 1211. Alternatively, the material of the first apex angle 1111 and the second apex angle 1211 may also be selected from other heat-resistant and conductive materials.

In an example, to realize discharging the electrostatic charges in the clearance area 13, the charge discharging members 111 and the charge recovering members 121 may have a saw-tooth shaped cross-section, i.e., including a wide base and a sharp corner formed by extending the two edges of the base. The wide base may facilitate the assemble with the antenna receiving terminal 11 or the charge releasing terminal 12, and the sharp corner structure may facilitate the arc discharge between the corresponding two sharp corners when the charge accumulation reaches the limit. Alternatively, the cross sections of the charge discharging member 111 and the charge recovering member 121 may also be other irregular shapes with sharp corners.

In addition, to ensure the discharge and the reliability of the structure, the charge discharging member 111 and the charge recovering member 121 are made of a material including a metal. Alternatively, the material of the charge discharging member 111 and the charge recovering member 121 may also be selected from other conductive materials.

Figure 3:
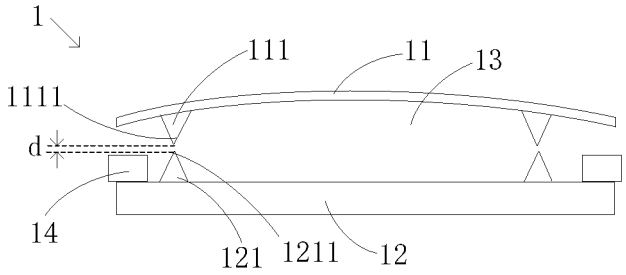
FIG. 3 is a sectional schematic diagram of an antenna assembly according to still another exemplary aspect of the present disclosure.

In the above examples, during the working process of the antenna assembly 1, communication signal is transmitted and received by the antenna receiving terminal 11 and the antenna receiving terminal 11 is connected to the main board of the electronic device 2, so as to realize the transmission of communication signal. If the antenna receiving terminal 11 is in direct contact with the charge releasing terminal 12, it may cause interference to the transmission of the communication signal, affecting the function related to the communication signal. Accordingly, as shown in FIG. 3, the antenna assembly 1 may further include an insulating separator 14, located between the antenna receiving terminal 11 and the charge releasing terminal 12 and assembled at the charge releasing terminal 12, so as to avoid the direct contact between the antenna receiving terminal 11 and the charge releasing terminal 12. Alternatively, the insulating separator 14 is assembled at the antenna receiving terminal 11. Other specific positions of the insulating separator 14 can be adopted as long as the direct contact between the antenna receiving terminal 11 and the charge releasing terminal 12 can be avoided.

Further, the insulating separator 14 is assembled at a periphery region of the antenna receiving terminal 11 or the charge releasing terminal 12, to reduce structural occupation and interference to the antenna receiving terminal 11 or the charge releasing terminal 12, thus improving the space utilization efficiency. It should be noted that the material of the insulating separator 14 may be an insulating material such as plastic or rubber.

It should be noted that the antenna assembly 1 of the present disclosure can be used in the electronic device 2 such as a mobile phone, a tablet computer, a vehicle terminal, a medical terminal in a full screen type, a non-full screen type, a slider type, a foldable type, so as to at least partially address the problems existing in the transmission and reception performances and the static electricity safety of the antenna assembly 1 in the electronic device 2. For example, the antenna assembly 1 is applied to a full-screen electronic device 2, and the structure of the antenna assembly 1 is illustrated as follows.

Figure 4:
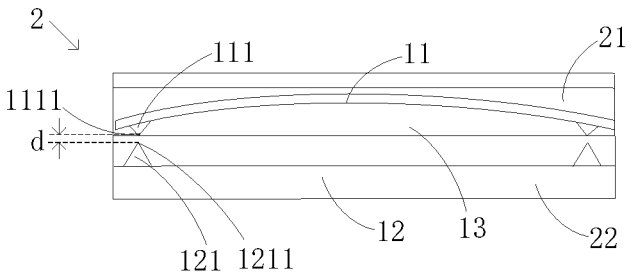
FIG. 4 is a sectional schematic diagram of an electronic device according to an exemplary aspect of the present disclosure.
Figure 5:
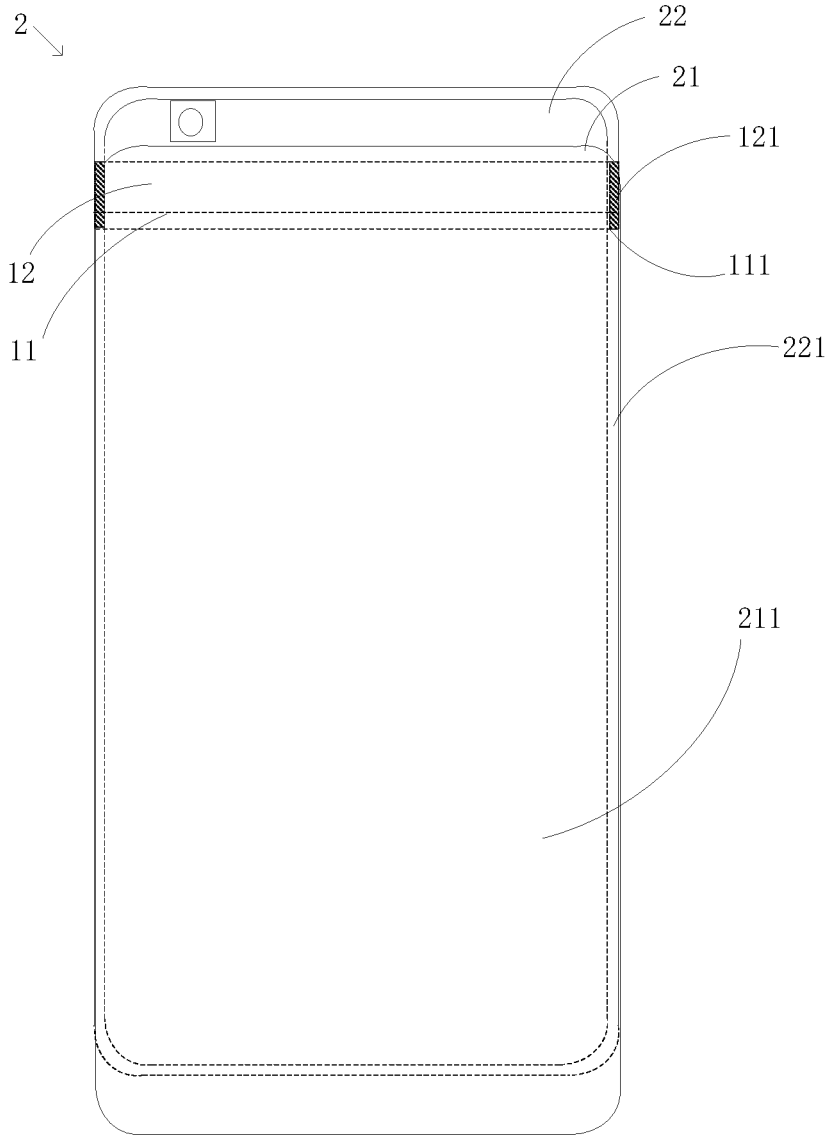
FIG. 5 is a schematic diagram of an electronic device in a working state according to an exemplary aspect of the present disclosure.
Figure 6:
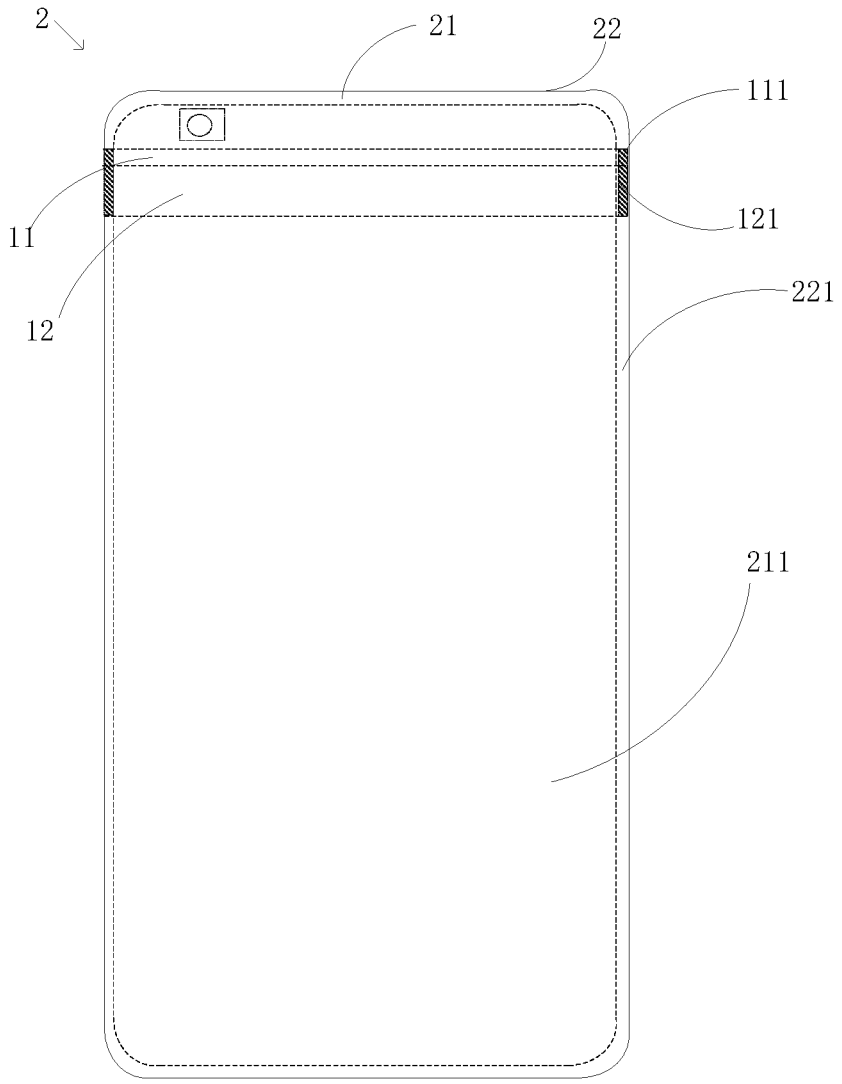
FIG. 6 is a schematic diagram of an electronic device in another working state according to an exemplary aspect of the present disclosure.

FIG. 4 is a sectional schematic diagram of an electronic device according to an exemplary aspect of the present disclosure. FIG. 5 is a schematic diagram of an electronic device in a working state according to an exemplary aspect of the present disclosure. FIG. 6 is a schematic diagram of an electronic device in another working state according to an exemplary aspect of the present disclosure. As shown in FIGS. 4, 5 and 6, the electronic device 2 includes a body, and the antenna assembly 1 as described above. The antenna assembly 1 is assembled to the body, and is used to realize the function of communication signal transmission and reception for the electronic device 2.

In an example, the body includes a first body 21 and a second body 22 that are stacked and slidably connected. Specifically, the antenna receiving terminal 11 is disposed at the first body 21, the charge releasing terminal 12 is disposed at the second body 22, and the charge releasing terminal 12 corresponds to the antenna receiving terminal 11 (i.e., the charge releasing terminal 12 is disposed at a position corresponding to that of the antenna receiving terminal 11) such that the distance between the first apex angle 1111 and the second apex angle 1211 is always less than or equal to the preset distance d.

In the process of the relative sliding of the first body 21 and the second body 22, there is no connection between the charge discharging member 111 and the charge recovering member 121 to cause interferences to each other, and the distance between the first apex angle 1111 and the second apex angle 1211 can be maintained to be less than or equal to the preset distance d, such that the electrostatic charges accumulated in the clearance area 13 and the first body 21 can be released by the arc discharge between the first apex angle 1111 and the second apex angle 1211, thus improving the reliability and efficiency of releasing the charges, and also avoiding the interference to the structure and function of the antenna assembly 1 caused by the electrostatic discharge. Therefore, the above structural arrangement further enhances the electrostatic safety performance of the antenna assembly 1 and the slider-type electronic device 2.

Further, the first body 21 includes a screen component 211 covering a front surface of the first body 21, the second body 22 includes a middle frame 221, the antenna receiving terminal 11 is assembled in an edge region of a back surface of the first body 21, and the charge releasing terminal 12 is assembled in a position of the middle frame 221 corresponding to the edge region. On this basis, for the full screen electronic device 2 in which the screen component 211 covers the front surface of the first body 21, the antenna receiving terminal 11 of the antenna assembly 1 of the present disclosure is disposed at the edge region of the back surface of the first body 21 while the charge releasing terminal 12 is assembled at the middle frame 221 of the second body 22. On one hand, interferences to the full screen effect on the screen component 211 of the antenna assembly 1 and to the structures of other functional components such as a camera can be avoided. On the other hand, the antenna assembly 1 will not affect the thickness of the electronic device 2.

Specifically, as shown in FIGS. 5 and 6, the first body 21 and the second body 22 of the electronic device 2 can slide upward and downward relative to each other. They can also slide in other directions such as in a left-right direction. For example, in the case where the first body 21 and the second body 22 relatively slide in the up-down direction, the antenna receiving terminal 11 may be disposed at the top edge region of the first body 21, and the charge discharging terminal 12 is correspondingly disposed at the top of the middle frame 221 of the second body 22, such that the distance between the first apex angle 1111 and the second apex angle 1211 is always less than or equal to the preset distance d during the relative sliding of the first body 21 and the second body 22, while avoiding the occupation of other spaces of the electronic device 2 and interference to the electronic device 2.

When the antenna assembly 1 is applied to the slider-type electronic device 2, the insulating separator 14 can also be assembled at the two ends of the second body 22 to avoid direct contact between the antenna receiving terminal 11 and the charge releasing terminal 12, thus avoiding space occupation in the antenna assembly 1 at the same time.

In another example, the body may be a whole tablet. The screen component 211 of the electronic device 2 covers the front surface of the body to form a full screen. Since the full screen may occupy the assembly space of the antenna assembly 1, the clearance area 13 of the antenna assembly 1 may be affected. On this basis, the antenna assembly 1 can be assembled at the top, bottom and both sides of the edge region of the body below the screen component 211. The distance between the first apex angle 1111 of the charge discharging member 111 and the second apex angle 1211 of the charge recovering member 121 is always less than or equal to the preset distance d, so that the electrostatic charges accumulated in the clearance area 13 are released through the arc discharge between the first apex angle 1111 and the second apex angle 1211.

On one hand, the electrostatic discharge in the antenna assembly 1 is released by the arc discharge formed between the first apex angle 1111 of the charge discharging member 111 and the second apex angle 1211 of the charge recovering member 121, and there is no connection between the charge discharging member 111 and the charge recovering member 121, thus interferences to the structure and function of the antenna assembly 1 for achieving electrostatic discharge are avoided, and the electrostatic safety of the antenna assembly 1 and the electronic device 2 is also improved. On the other hand, since both the charge discharging member 111 and the charge recovering member 121 extend in the clearance area 13, no matter the antenna assembly 1 is arranged in a thickness, length or width direction of the electronic device 2, the thickness of the electronic device 2 will not be affected, thus improving the flexibility of arranging the antenna assembly 1 and optimizing the internal space arrangement of the electronic device 2 at the same time.

It should be noted that the other configurations of the antenna receiving terminal 11, the charge releasing terminal 12, the charge discharging member 111, the charge recovering member 121 applied to the antenna assembly 1 of the electronic device 2 are the same as those in the above examples, and thus are not described in detail here again.

In the antenna assembly 1 provided in the examples of the present disclosure, the antenna receiving terminal 11 is arranged at a side of the clearance area 13 and the charge releasing terminal 12 is arranged at the other side of the clearance area 13, and the charge discharging member 111 is disposed at the conductive region of the antenna receiving terminal 11 and the charge recovering member 121 is disposed at the conductive region of the charge releasing terminal 12, such that the distance between the first apex angle 1111 of the charge discharging member 111 and the second apex angle 1211 of the charge recovering member 121 is less than or equal to the preset distance, and thus the electrostatic charges accumulated in the antenna receiving terminal 11 and the clearance area 13 can be released by the arc discharge between the first apex angle 1111 and the second apex angle 1211. The above structure is simple to set up, reduces interferences to the structure and function of the whole antenna assembly 1, and also improves the electrostatic safety of the antenna assembly 1 and the electronic device 2. Thus, the antenna assembly and the electronic device with improved antenna performances and electrostatic safety are provided according to the examples of the present disclosure.

Other examples of the present disclosure will be apparent to those skilled in the art from consideration of the specification and practice of the present disclosure disclosed here. This application is intended to cover any variations, uses, or adaptations of the present disclosure following the general principles thereof and including such departures from the present disclosure as come within known or customary practice in the art. It is intended that the specification and examples be considered as exemplary only.

It will be appreciated that the present disclosure is not limited to the exact construction that has been described above and illustrated in the accompanying drawings, and that various modifications and changes can be made without departing from the scope thereof.

What is claimed is:

1. An antenna assembly, comprising:

an antenna receiving terminal comprising a first conductive region;

a charge releasing terminal comprising a second conductive region;

a clearance area disposed between the antenna receiving terminal and the charge releasing terminal, wherein the antenna receiving terminal, the clearance area, and the charge releasing terminal are arranged in a stacked configuration;

a charge discharging member disposed at the first conductive region of the antenna receiving terminal, wherein the charge discharging member extends toward the charge releasing terminal, and forms a first apex angle close to the charge releasing terminal; and a charge recovering member corresponding to the charge discharging member disposed at the second conductive region of the charge releasing terminal, wherein the charge recovering member extends toward the antenna receiving terminal, and forms a second apex angle close to the antenna receiving terminal, wherein a distance between the first apex angle and the second apex angle is less than or equal to a preset distance, so as to initiate an arc discharge between the first apex angle and the second apex angle.

2. The antenna assembly as claimed in claim 1, wherein two charge discharging members are disposed at two opposite ends of the first conductive region of the antenna receiving terminal.

3. The antenna assembly as claimed in claim 1, wherein a plurality of charge discharging members is uniformly distributed at the first conductive region of the antenna receiving terminal.

4. The antenna assembly as claimed in claim 1, wherein the preset distance is less than or equal to 1.2 mm.

5. The antenna assembly as claimed in claim 1, wherein the charge discharging member and the charge recovering member are made of a material comprising a metal.

6. The antenna assembly as claimed in claim 1, wherein the charge discharging member and the charge recovering member have a saw-tooth shaped cross-section.

7. The antenna assembly as claimed in claim 1, wherein the first apex angle of the charge discharging member and the second apex angle of the charge recovering member are made of a material comprising gold.

8. The antenna assembly as claimed in claim 1, further comprising:

an insulating separator, located between the antenna receiving terminal and the charge releasing terminal and assembled at the antenna receiving terminal or the charge releasing terminal.

9. The antenna assembly as claimed in claim 8, wherein the insulating separator is assembled at a periphery region of the antenna receiving terminal or the charge releasing terminal.

10. An electronic device, comprising:

a body, and an antenna assembly assembled in the body, the antenna assembly comprising:

an antenna receiving terminal comprising a first conductive region;

a charge releasing terminal comprising a second conductive region;

a clearance area disposed between the antenna receiving terminal and the charge releasing terminal, wherein the antenna receiving terminal, the clearance area, and the charge releasing terminal are arranged in a stacked configuration;

a charge discharging member disposed at the first conductive region of the antenna receiving terminal, wherein the charge discharging member extends toward the charge releasing terminal, and forms a first apex angle close to the charge releasing terminal; and a charge recovering member corresponding to the charge discharging member disposed at the second conductive region of the charge releasing terminal, wherein the charge recovering member extends toward the antenna receiving terminal, and forms a second apex angle close to the antenna receiving terminal, wherein a distance between the first apex angle and the second apex angle is less than or equal to a preset distance, so as to initiate an arc discharge between the first apex angle and the second apex angle.

11. The electronic device as claimed in claim 10, wherein the body comprises a first body and a second body that are stacked and slidably connected, wherein the antenna receiving terminal is disposed at the first body, the charge releasing terminal is disposed at the second body, and the charge releasing terminal corresponds to the antenna receiving terminal such that the distance between the first apex angle and the second apex angle is always less than or equal to the preset distance.

12. The electronic device as claimed in claim 11, wherein the first body comprises a screen component covering a front surface of the first body, the second body comprises a middle frame, the antenna receiving terminal is assembled in an edge region of a back surface of the first body, and the charge releasing terminal is assembled in a position of the middle frame corresponding to the edge region of the back surface of the first body.

13. The electronic device as claimed in claim 10, wherein two charge discharging members are disposed at two opposite ends of the first conductive region of the antenna receiving terminal.

14. The electronic device as claimed in claim 10, wherein a plurality of charge discharging members is uniformly distributed at the first conductive region of the antenna receiving terminal.

15. The electronic device as claimed in claim 10, wherein the preset distance is less than or equal to 1.2 mm.

16. The electronic device as claimed in claim 10, wherein the charge discharging member and the charge recovering member are made of a material comprising a metal.

17. The electronic device as claimed in claim 10, wherein the charge discharging member and the charge recovering member have a saw-tooth shaped cross-section.

18. The electronic device as claimed in claim 10, wherein the first apex angle of the charge discharging member and the second apex angle of the charge recovering member are made of a material comprising gold.

19. The electronic device as claimed in claim 10, the antenna assembly further comprises:

an insulating separator, located between the antenna receiving terminal and the charge releasing terminal and assembled at the antenna receiving terminal or the charge releasing terminal.

20. The electronic device as claimed in claim 19, wherein the insulating separator is assembled at a periphery region of the antenna receiving terminal or the charge releasing terminal.

* * * * *